US006125641A

United States Patent [19]

Kim et al.

[11] Patent Number: 6,125,641

[45] Date of Patent: Oct. 3, 2000

[54] METHOD FOR PREVENTING FORMATION OF ICE ON DAMPER IN REFRIGERATOR

[75] Inventors: Seok Ro Kim; Yong Seok Park, both of Kyungsangnam-do, Rep. of Korea

[73] Assignee: LG Electronics Inc., Seoul, Rep. of Korea

[21] Appl. No.: 09/280,848

[22] Filed: Mar. 30, 1999

[30] Foreign Application Priority Data

| | | | |
|---|---|---|---|
| Mar. 31, 1998 | [KR] | Rep. of Korea | 98-11268 |
| Oct. 21, 1998 | [KR] | Rep. of Korea | 98-44101 |
| Oct. 21, 1998 | [KR] | Rep. of Korea | 98-44106 |

[51] Int. Cl.[7] ..... F25D 17/04

[52] U.S. Cl. ..... 62/187

[58] Field of Search ..... 62/187, 282, 273, 62/275

[56] References Cited

U.S. PATENT DOCUMENTS

| | | | |
|---|---|---|---|
| Re. 27,990 | 4/1974 | Rivard et al. | 62/419 |
| 4,852,361 | 8/1989 | Oike | 62/131 |

FOREIGN PATENT DOCUMENTS

| | | | |
|---|---|---|---|
| 0133667 | 5/1994 | Japan | 62/187 |
| 406137737 | 5/1994 | Japan | 62/187 |

*Primary Examiner*—William Doerrler
*Assistant Examiner*—Marc Norman
*Attorney, Agent, or Firm*—Fleshner & Kim, LLP

[57] ABSTRACT

Method for preventing formation of ice on a damper in a refrigerator, comprising the steps of (1) driving a compressor and a fan and opening baffles if a freezing room temperature is lower than a freezing room reference temperature and a chilling room temperature is lower than a chilling room reference temperature, (2) comparing the chilling room temperature to the chilling room reference temperature, to close the baffles if the chilling room temperature is lower than the chilling room reference temperature, (3) comparing the freezing room temperature to the freezing room reference temperature, to stop the compressor and the fan if the freezing room temperature is lower than the freezing room reference temperature, (4) comparing an outside temperature of the refrigerator to an outside reference temperature, to return back to the step (1) if the outside temperature of the refrigerator is higher than the outside reference temperature, and determining chilling room door of being opened if the outside temperature of the refrigerator is lower than the outside reference temperature, and (5) comparing a temperature difference before and after opening/closing of the chilling room door to a given reference temperature, to return back to the step (1) if the temperature difference is lower than the reference temperature, and to open the baffles of the damper and to drive the fan for a given time period if the temperature difference is higher than the reference temperature.

5 Claims, 7 Drawing Sheets

(a)

(b)

METHOD FOR PREVENTING FORMATION OF ICE ON DAMPER IN REFRIGERATOR

BACKGROUND OF THE INVENTION

1. Field of the Invention

The present invention relates to a method for controlling a refrigerator, and more particularly, to a method for preventing formation of ice on a damper in a refrigerator, which damper is provided in a cooled air flow passage for selective supply of the cooled air to a chilling chamber.

2. Background of the Related Art

The refrigerator is an appliance which maintains food stored in the refrigerator at a required temperature using a refrigerating cycle of a refrigerant having compression, condensation, expansion, and evaporation. The refrigerator including a freezing room and a chilling room is provided with a refrigerator body and different components fitted to various positions of the body for conducting the refrigerating cycle. The components for conducting the refrigerating cycle are a compressor, an evaporator, an expansion valve, a condenser, a fan, and etc. The evaporator is provided in a heat exchange chamber in rear of the freezing chamber, wherein the refrigerant makes heat exchange with ambient air and is evaporated into gaseous refrigerant, while cooling down the ambient air. The air cooled down at the heat exchange with the refrigerant at the evaporator is blown by a fan, to flow toward, one portion to the freezing room and the other portion to the chilling room, of which flow of the cooled air toward the chilling room is adjusted by the damper. The cooled down air supplied to the freezing room and the chilling room thus is turned into air of relatively high temperature through heat exchange with the food stored therein, and circulates therefrom through the evaporator, again.

FIG. 1 illustrates a front view of a related art refrigerator, FIG. 2 illustrates a section across a line I—I in FIG. 1, referring to which a related art refrigerator and a damper in the refrigerator will be explained.

Inside of the refrigerator 1 is divided by a barrier 30 having insulator stuffed therein into a freeze room 3 and a chilling room 4, and there is a heat exchange chamber 10 on a rear wall of the freeze room 3, and the heat exchange chamber 10 is provided with an evaporator 10*a*. There is a cooled air discharge passage 12 formed in the barrier 30 for moving the cooled air heat exchanged in the heat exchange chamber 10 to the chilling room 4, together with return passages 14 and 16 for returning the cooled air circulated through the freeze room 3 and the chilling room 4 respectively back to the heat exchange room 10, again. The return passages 14 and 16 are formed not to be overlapped with the cooled air discharge passage 12. In the meantime, an outlet of the cooled air discharge passage 12 is connected to the cooled air flow passage 36, and there is a damper 20 fitted to an outlet of the cooled air flow passage 36 for controlling cooled air flow into the chilling room 4, and there is a plurality of cooled air discharge openings 32 and 34 for discharging the cooled air into the chilling room 4. And, there are temperature sensors 9 and 11 at left and right inside walls or a rear inside wall of the chilling room 4 for sensing temperatures of the chilling room. The damper 20 is provided with baffles 22 and 22*a* for selective shut off of the cooled air flow passage 36 and plate springs 24 and 24*a* for supporting the baffles 22 and 22*a* respectively, wherein the baffles 22 and 22*a* are controlled mechanically or electrically based on the temperatures measured at the chilling room temperature sensors 9 and 11. The damper 20 may be provided with on baffle even though the damper 20 shown in FIG. 1 is provided with two baffles 22 and 22*a*. As shown in FIG. 1, if there are two baffles 22 and 22*a* provided to the damper, one baffle(a first baffle) 22 is adapted to shut off the cooled air flow passage 36 connected to the cooled air opening 32 which discharges cooled air into a middle compartment 5 of the chilling room 4 selectively, and the other baffle(a second baffle) 22*a* is adapted to shut off the cooled air flow passage 36 connected to the cooled air opening 34 which discharges cooled air into a low compartment 7 of the chilling room 4, selectively. In this instance, the middle compartment and the low compartment 32 and 34 are of course formed separately and individually, with temperature sensors 9 and 11 at the middle and low compartments 5 and 7 respectively, for respective control of the two baffles 22 and 22*a*.

A method for controlling the related art refrigerator will be explained with reference to FIGS. 1~3.

The method for controlling the related art refrigerator starts with comparing a freezing room temperature Tf measured by a freezing room temperature sensor(not shown) to a freezing room reference temperature Tf.ref for determining drive of the refrigerator 1(S1). If the freezing room temperature Tf is higher than the freezing room reference temperature Tf.ref as a result of the comparison, the refrigerator is put into operation. That is, the compressor and the fan(not shown) are operated for making the refrigerating cycle(S3). If the chilling room temperature Tc does not satisfy the chilling room reference temperature Tc.ref, the baffles 22 and 22*a* are opened to supply the cooled air to the chilling room 4(S5 and S7). Accordingly, the cooled air cooled by heat exchange at the evaporator is supplied to the freeze room 3 and the chilling room 4. Then, the chilling room temperature Tc is compared to the chilling room reference temperature Tc.ref again(S9), to close the baffles 22 and 22*a* (S10) for preventing an excessive cooling down of the chilling room if the chilling room temperature Tc is below the chilling room reference temperature Tc.ref. Next, the freezing room temperature Tf is compared to the freezing room reference temperature Tf.ref, to stop the drive of the refrigerator if the freezing room temperature Tf is lower than the freezing room reference temperature Tf.ref. That is, operation of the compressor and the fan are stopped(S13 and S15). Under this state, if the freezing room temperature Tf is higher than the freezing room reference temperature Tf.ref, the compressor and fan are operated again, to drive the refrigerator(S1 and S3). The refrigerator is operative repeating the foregoing process, wherein the freeze room reference temperature Tf.ref is −18° C. and the chilling room reference temperature Tc.ref is 3° C.

In the meantime, if an outside temperature Tout of the refrigerator is low(about 10° C.), an operation factor of the refrigerator drops below 20% as there is substantially no heat exchange in the freezing room because a temperature difference between inside and outside of the refrigerator is not great with a consequential low frequency of operation of the chilling room. And, since a temperature difference between the chilling room temperature Tc and the outside temperature Tout is not so great, the baffles 22 and 22*a* are almost not opened, putting inside of the chilling room into a state of no cooled air circulation.

The related art refrigerator has the following problems when the refrigerator is used in a comparatively low outside temperature Tout.

When the compressor and the fan are driven while the baffles 22 and 22*a* are opened, there is no problem of ice formation on the damper 20 as the cooled air circulates inside of the chilling room 4. However, when food with high temperature and high humidity is introduced into the chilling room or when an external air with high temperature and high humidity is introduced into the chilling room by open/closing of the chilling room door under a state the baffles are closed and the compressor and the fan are stopped as the freezing room temperature Tf and the chilling room temperature Tc respectively satisfy the freezing room reference temperature Tf.ref and the chilling room reference temperature Tc.ref, moisture adheres on surfaces of the baffles 22 and 22*a* or on the cooled air flow passage 36 around the baffles 22 and 22*a,* to form water drops, which are grown into ice. This is because surface temperatures of the baffles are kept relatively lower than the chilling room temperature Tc as the cooled air does not flows into the chilling room 4, but is stationary around the baffles 22 and 22*a* when the baffles 22 and 22*a* are closed as the chilling room temperature satisfies the temperature condition. Accordingly, the air with high temperature and high humidity introduced from outside of the refrigerator or the air evaporated from the food with high temperature and high humidity adheres on surfaces of the baffles 22 and 22*a* of the damper 20, forming ice on the baffles 22 and 22*a*. Moreover, the almost no circulation of air in the chilling room 4 as the baffles 22 and 22*a* are closed enhances the ice formation on the surfaces of the baffles 22 and 22*a* which have relative low temperatures. As has been explained, this ice formation becomes more serious when the refrigerator is in a cold region, i.e., when the operation factor of the refrigerator is low, because there is scarce air circulation in the chilling room in the refrigerator. Once ice is formed on the damper 20, open/closing of the baffles 22 and 22*a* can not be made properly according to a temperature in the chilling room 4, resulting in failing of a proper control of cooled air discharge into the chilling room. The failure of a proper control of cooled air discharge into the chilling room causes an excessive drop of the chilling room temperature Tc below the chilling room reference temperature Tc.ref, cooling down the food excessively, that degrades the food and increases a power consumption.

In order to solve such problems, a method for melting the ice on the baffles 22 and 22*a* has been suggested. However, the method has problems in that a production cost of the refrigerator becomes high and a structure of the refrigerator is complicated because a heater should be provided.

SUMMARY OF THE INVENTION

Accordingly, the present invention is directed to a method for preventing formation of ice on a damper in a refrigerator that substantially obviates one or more of the problems due to limitations and disadvantages of the related art.

An object of the present invention is to provide a method for preventing formation of ice on a damper in a refrigerator, which can prevent formation of ice on a damper effectively without using any additional device.

Another object of the present invention is to provide a method for preventing formation of ice on a damper in a refrigerator, which can reduce a power consumption and prevent excessive cooling down of a chilling room.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for preventing formation of ice on a damper in a refrigerator, comprising the steps of (1) driving a compressor and a fan and opening baffles if a freezing room temperature is lower than a freezing room reference temperature and a chilling room temperature is lower than a chilling room reference temperature, (2) comparing the chilling room temperature to the chilling room reference temperature, to close the baffles if the chilling room temperature is lower than the chilling room reference temperature, (3) comparing the freezing room temperature to the freezing room reference temperature, to stop the compressor and the fan if the freezing room temperature is lower than the freezing room reference temperature, (4) comparing an outside temperature of the refrigerator to an outside reference temperature, to return back to the step (1) if the outside temperature of the refrigerator is higher than the outside reference temperature, and determining chilling room door of being opened if the outside temperature of the refrigerator is lower than the outside reference temperature, and (5) comparing a temperature difference before and after opening/closing of the chilling room door to a given reference temperature, to return back to the step (1) if the temperature difference is lower than the reference temperature, and to open the baffles of the damper and to drive the fan for a given time period if the temperature difference is higher than the reference temperature.

The freezing room reference temperature is −18° C., the chilling room reference temperature is 3° C. and the outside reference temperature is 8.5~12.5° C.

In a case of a refrigerator with two baffles, the two baffles are preferably opened in the step (5), not on the same time, but a first baffle positioned far from the cooled air flow passage at first and a second baffle near to the cooled air flow passage at second after lapse of a given time period.

By providing the aforementioned system, formation of ice on a damper when a refrigerator is used in a low temperature environment can be prevented.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
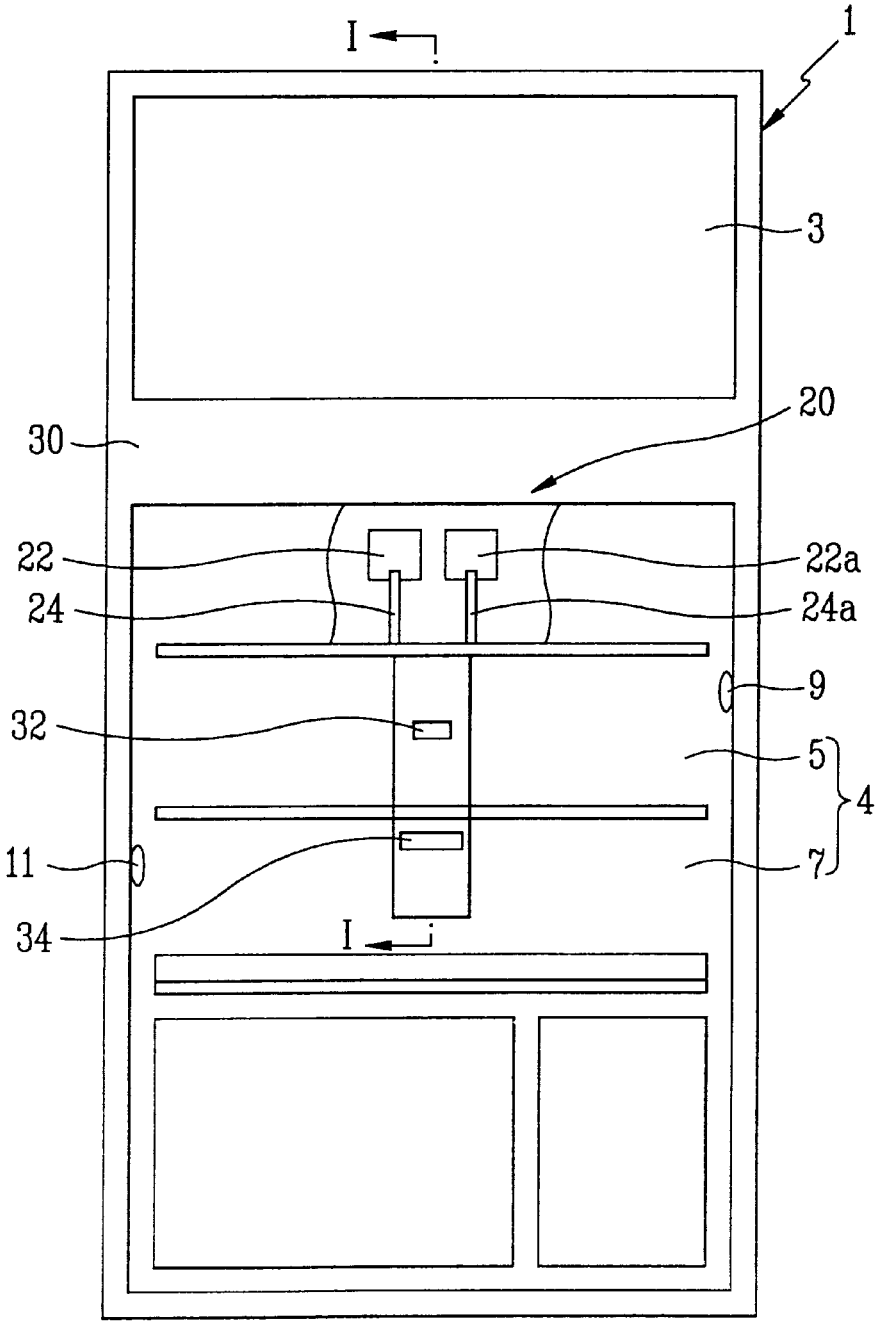
FIG. 1 Background Art
FIG. 1 illustrates a front view of a related art refrigerator.
Figure 2:
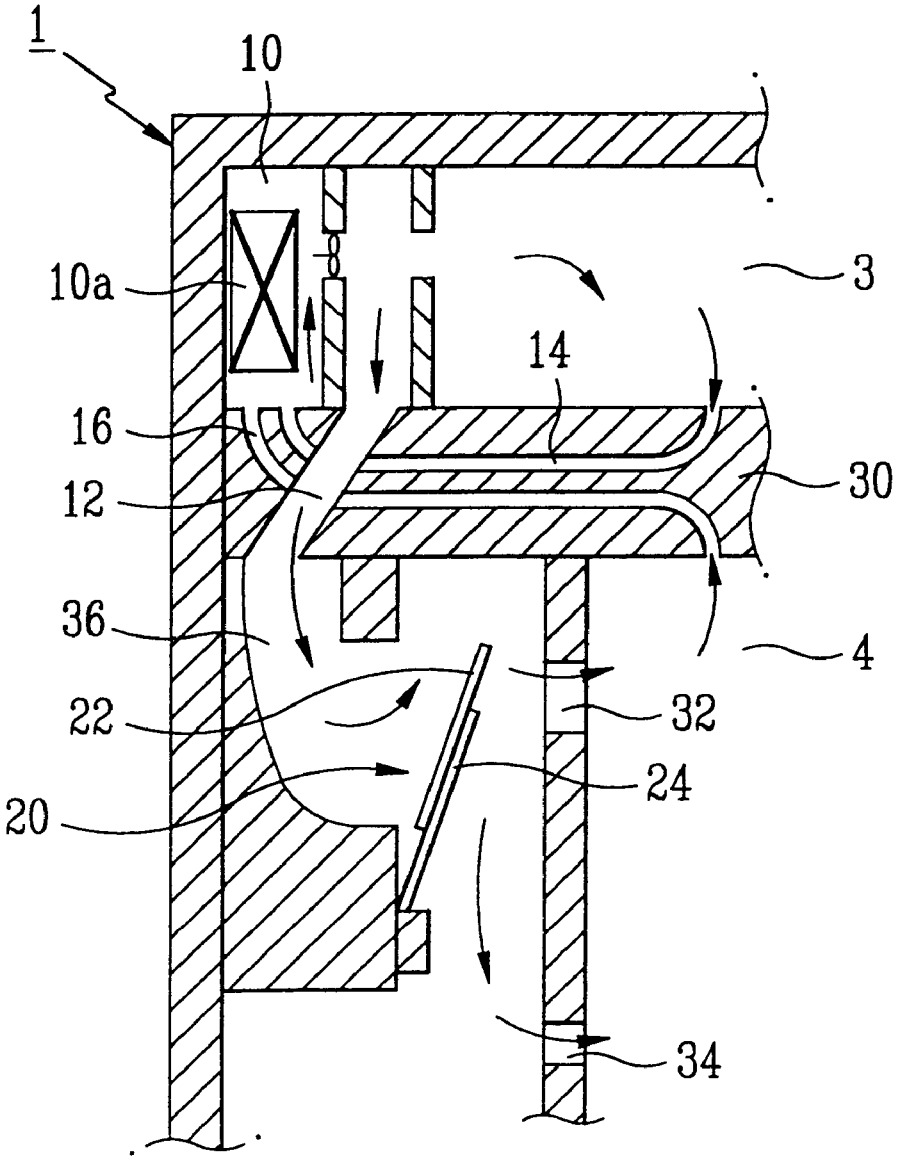
FIG.2 Background Art
FIG. 2 illustrates a section across line I—I in FIG. 1.
Figure 3:
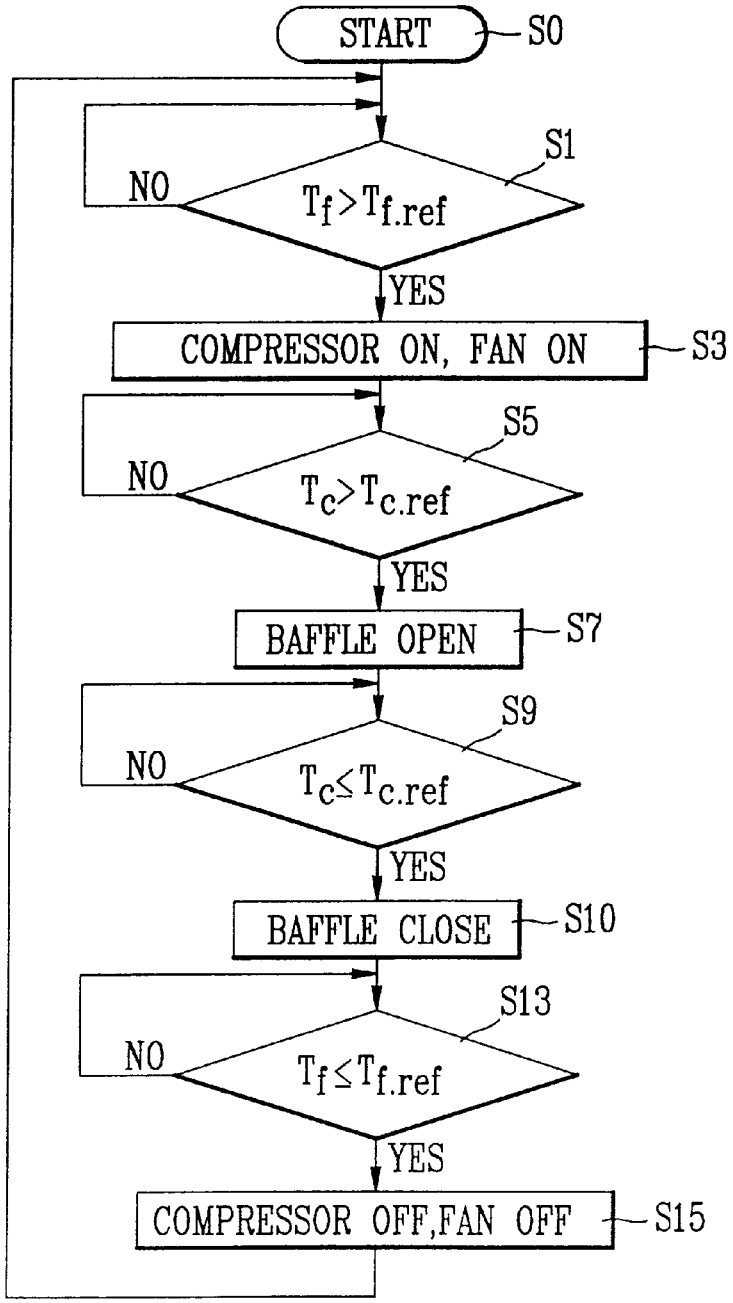
FIG.3 Background Art
FIG. 3 illustrates a flow chart showing a related art method for controlling a refrigerator.
Figure 4:
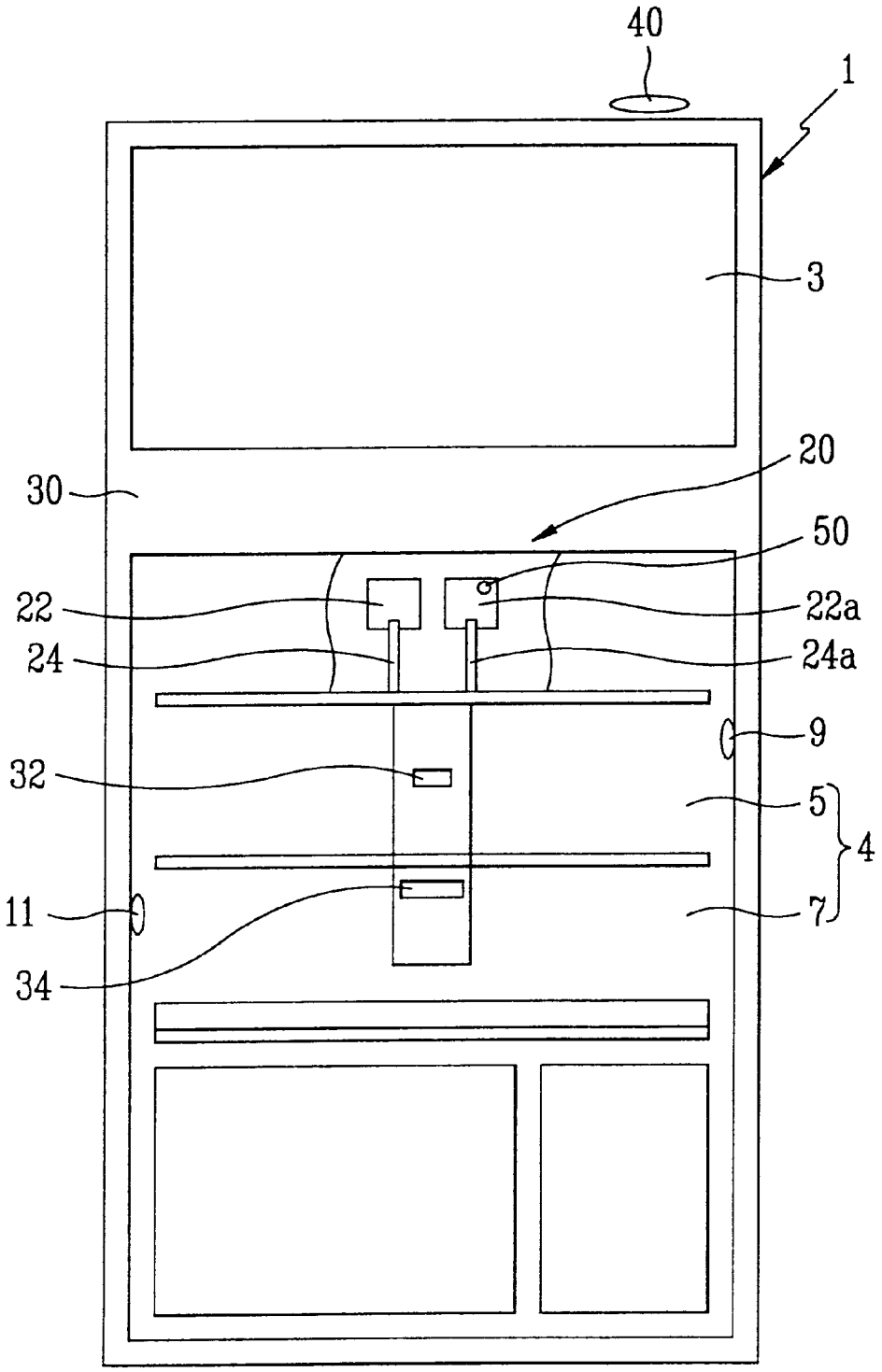
FIG. 4 schematically illustrates a front view of a refrigerator to which a method for preventing formation of ice on a damper in a refrigerator of the present invention is applied.
Figure 5:
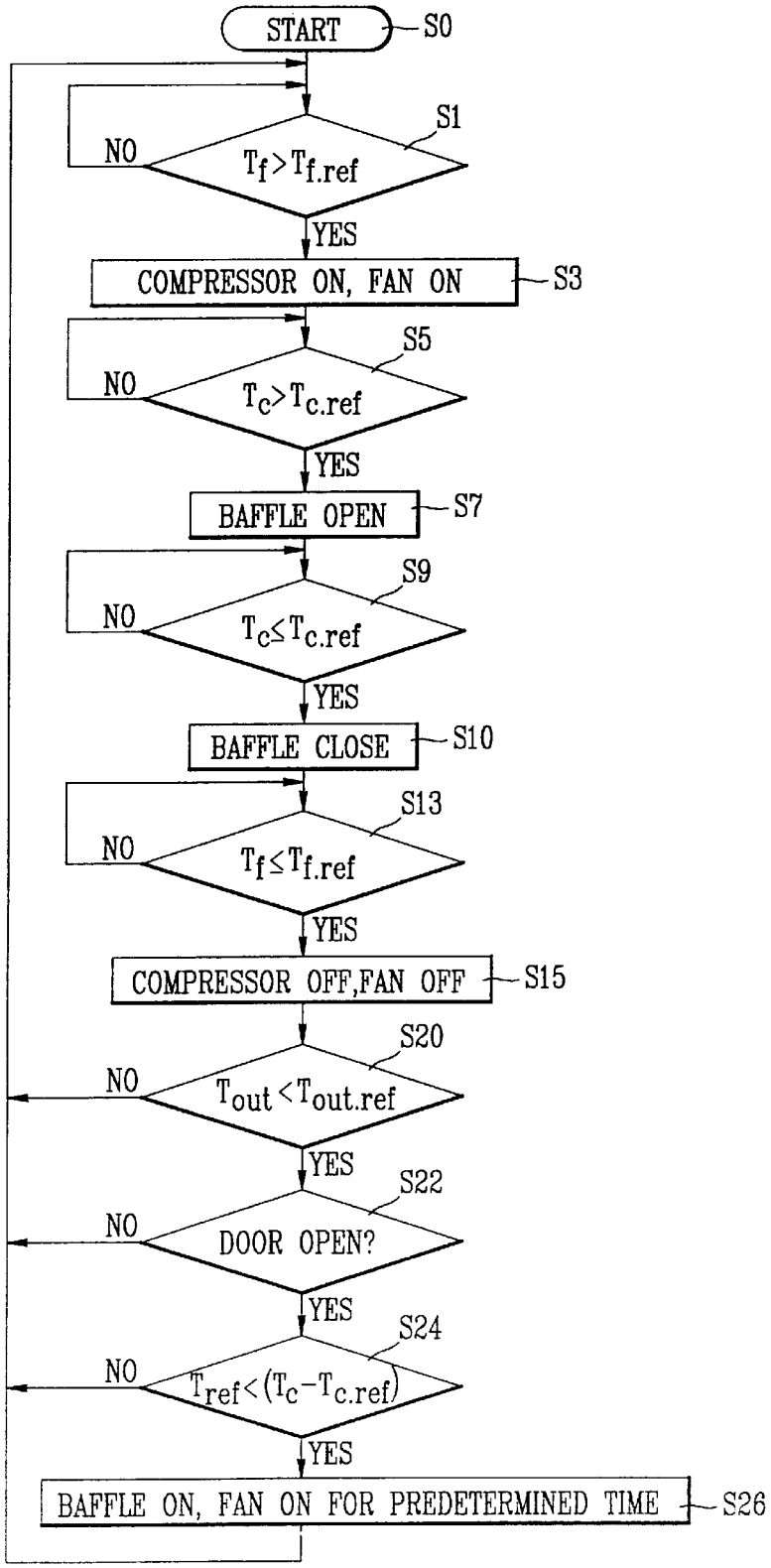
FIG. 5 illustrates a flow chart showing a method for preventing formation of ice on a damper in a refrigerator in accordance with a first preferred embodiment of the present invention.

Reference will now be made in detail to the preferred embodiments of the present invention, examples of which are illustrated in the accompanying drawings. FIG. 4 schematically illustrates a front view of a refrigerator to which a method for preventing formation of ice on a damper in a refrigerator of the present invention is applied, and FIG. 5 illustrates a flow chart showing a method for preventing formation of ice on a damper in a refrigerator in accordance with a first preferred embodiment of the present invention. Though a refrigerator with two baffles are shown in FIG. 4, the present invention is not limited to this, but the present invention is applicable to a refrigerator with one baffle. Components of the present invention identical to the components in the related art are given the same reference numerals, and explanations of which will be omitted. And, the steps in the method of the present invention identical to the steps in the related art method are given the same reference numerals, and explanations of which will be also omitted.

The present invention can prevent formation of ice on a damper and on a cooled air passage around the damper by minimizing a temperature difference between a temperature of food with high temperature and high humidity introduced into the chilling room or a temperature of an external air with high temperature and high humidity introduced into the chilling room when a chilling room door is opened/closed in a case when an ambient temperature of the refrigerator is low.

A structure of the refrigerator to which the method of the present invention is applicable will be explained with reference to FIG. 4. The structure of the refrigerator to which the method of the present invention is applicable is substantially the same with the related art refrigerator, except that an external temperature sensor 40 is provided outside of the refrigerator, for detecting an environment of the refrigerator in which the refrigerator is used, i.e., an external temperature Tout of the refrigerator, to control the refrigerator, properly. A baffle temperature sensor 50 is fitted to a given position of each of the baffles 22 and 22*a* for sensing a surface temperature of each of the baffles 22 and 22*a*.

A method for preventing formation of ice on a damper in a refrigerator in accordance with a preferred embodiment of the present invention will be explained with reference to FIGS. 4 and 5.

If a freezing room temperature Tf measured by a freezing room temperature sensor(not shown) is not reached to a freezing room reference temperature(−18° C. usually) Tf.ref, the refrigerator is driven, continuously(S1 and S3). And, if a chilling room temperature Tc sensed by chilling room temperature sensors 9 and 11 is not reached to a chilling room reference temperature Tc.ref, baffles 22 and 22*a* of the damper 20 is opened, permitting the cooled air from the evaporator being supplied to the freezing room 3 and the chilling room 4(S5 and S7). When the chilling room temperature Tc is reached to the chilling room reference temperature(3° C. usually) Tc.ref, the baffles 22 and 22*a* of the damper are closed for cutting off the cooled air supply to the chilling room 4(S9 and S10). Then, the refrigerator is driven(S13) until the freezing room temperature Tf is reached to the freezing room reference temperature Tf.ref, and when the freezing room temperature Tf is reached to the freezing room reference temperature Tf.ref, the compressor and the fan are stopped(S15). The aforementioned steps are the same with the related art steps. Under this state, the external temperature sensor 40 senses an outside temperature Tout of the refrigerator. If the outside temperature Tout is higher than a given outside reference temperature Tout.ref, the refrigerator is controlled the same with the related art(S20), because there is less possibility of ice formation on the baffles 22 and 22*a* of the damper 20 due to the high operation factor of the refrigerator with a frequent cooling air circulation even if food with high temperature and high humidity is introduced into the chilling room or an external air with high temperature and high humidity is introduced into the chilling room. However, as explained in the related art, in the case when the outside temperature Tout is lower than the outside reference temperature Tout.ref, there is possibility of ice formation on the baffles 22 and 22*a* and parts around the baffles 22 and 22*a,* when air with high humidity is introduced into the chilling room 4. The outside reference temperature Tout.ref which is a reference temperature of ice formation is set to be approx. 8.5° C.~12.5° C. Because the operation factor of the refrigerator drops down below 20% when the outside temperature Tout is in a range of approx. 8.5° C.~12.5° C., with scarce circulation of air in the chilling room 4 and a high possibility of ice formation on the damper 20. However, the outside reference temperature Tout.ref is not fixed, and may be set appropriately taking conditions such as the freeze room reference temperature Tf.ref, the chilling room reference temperature Tc.ref, and the environment in which the refrigerator is used into consideration. By the way, if the outside temperature Tout is lower than the outside reference temperature Tout.ref, opening of the chilling room door is detected(S20 and S22). If the chilling room door is opened, external air will be introduced into the chilling room 4 with a rise of the chilling room temperature Tc. If the chilling room temperature Tc rises to a temperature high than a preset reference temperature Tref, the baffles 22 and 22*a* are opened for a given time period and the fan is driven(S26) as there is a possibility of ice formation on the damper 20 due to a temperature difference between the damper 20, the introduced external air and the chilling room. That is, it is determined whether a temperature difference Tc-Tc.ref before and after the opening/closing of the chilling room door is higher than a reference temperature Tref or not. If the temperature difference Tc-Tc.ref is higher than the reference temperature Tref, the baffles 22 and 22*a* are opened and the fan is driven. And, upon elapse of an opening time period of the baffles 22 and 22*a* and a fan driving time period, the baffles 22 and 22*a* are closed again and the fan is stopped again, to return to a regular operation condition(S26). Though a temperature before opening the chilling room door is assumed to be the chilling room reference temperature Tc.ref in calculation of the temperature difference before and after opening/closing the chilling room door, of course, it is also possible to use a temperature measured before opening the chilling room door by the chilling room temperature sensors 9 and 11. And, the reference temperature Tref for determining a possibility of ice formation may be set appropriately by experiments. The time period of opening the baffle 22 and 22*a* and the time period of driving the fan are set to be a time period in which a temperature of the baffles 22 and 22*a* and a temperature of the chilling room becomes the same. Because the ice is formed on the baffles 22 and 22*a* or on the cooled air flow passage, which are at a relatively low temperature, due to the temperature difference between the chilling room temperature Tc and the temperature of the introduced food or the external air. The set time period may be determined by experiment to satisfy the aforementioned condition. As another criterion for setting time periods for driving the baffles and the fan, a time point until a baffle surface temperature reaches to over 0° C. may be taken by fitting a baffle temperature sensor 50 on a surface of the baffle, because if the baffle surface temperature is over 0° C., there is no possibility of the moisture on the baffle surface to grow into ice. In the meantime, though the baffles 22 and 22*a* are driven in association with the drive of the fan(S26) in the aforementioned embodiment, the objects of the present invention can be achieved even if the baffles 22 and 22*a* are only opened while the fan is not driven. However, if the opening of the baffles 22 and 22*a* together with the fan drive are made on the same time as before, cooled air circulations in the refrigerator become more active, facilitating more effective prevention of the ice formation on the baffles 22 and 22*a*. The aforementioned series of control steps are entered into a microcomputer, for controlling drive of the compressor, the fan and the baffles according to various information coming from different sensors to the microcomputer.

As has been explained, the method of the present invention can prevent formation of ice on the baffles 22 and 22*a* of the damper 20 even if food with high temperature and high humidity or external air with high humidity is introduced into the chilling room when the refrigerator is in used in a low temperature environment. It is verified form chilling room door opening/closing experiments and high temperature and high humidity load introducing experiments according to the method for preventing formation of ice on a damper in a refrigerator of the present invention that there is no ice formation on the baffles 22 and 22*a* and the part around the baffles 22 and 22*a*. In conclusion, the method of the present invention allows to reduce cost of the refrigerator as fitting of a device such as a heater is not required for removal of ice formed on the baffles 22 and 22*a*. And, the prevention of ice formation on the damper 20 allows a proper control of the damper 20, that in turn allows to prevent excessive cooling down of the chilling room and a loss of the power consumption.

Figure 6:
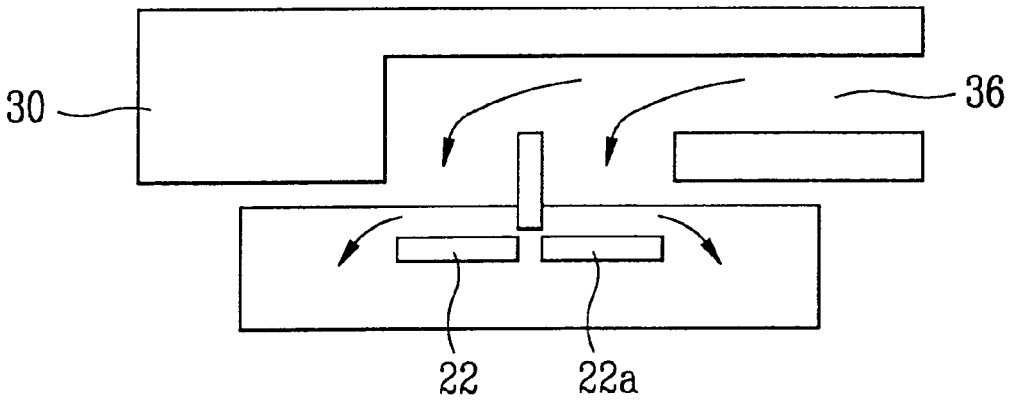
FIGS. 6*a* and 6*b* illustrate sections schematically showing a damper with two baffles for explaining a cooled air flow in a case of two baffles provided; and, FIG. 7 illustrates a flow chart showing a method for preventing formation of ice on a damper in a refrigerator in accordance with a second preferred embodiment of the present invention.
Figure 6:
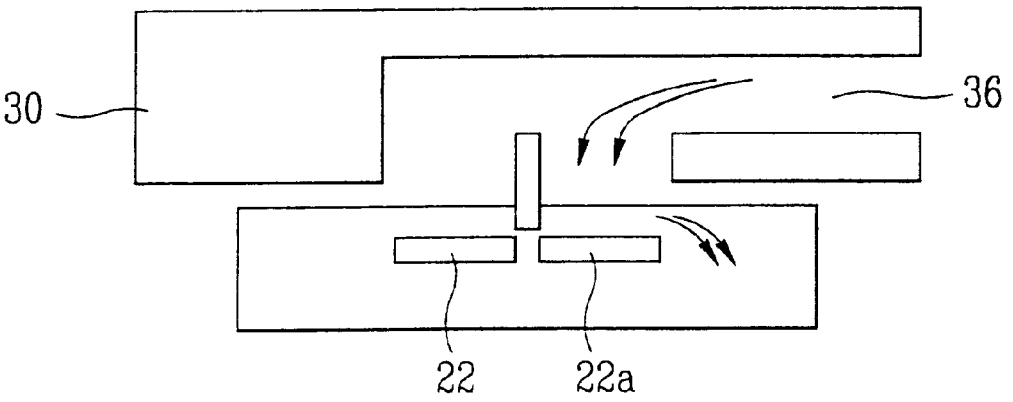

In the meantime, if it is intended to apply this embodiment method to a refrigerator having a damper with two baffles fitted for controlling cooled air for each compartment of the chilling room, it is preferable that the embodiment method is modified, because there is a possibility of ice formation if the two baffles are opened on the same time, as the cooled air flows, not uniformly as shown in FIG. 6*a,* but toward the baffle 22*a* nearer to the cooled air flow passage mostly with a weak flow of the cooled air toward the far side baffle 22 as shown in FIG. 6*b*. This is particularly serious when the baffles 22 and 22*a* are left open while the fan is stopped.

Figure 7:
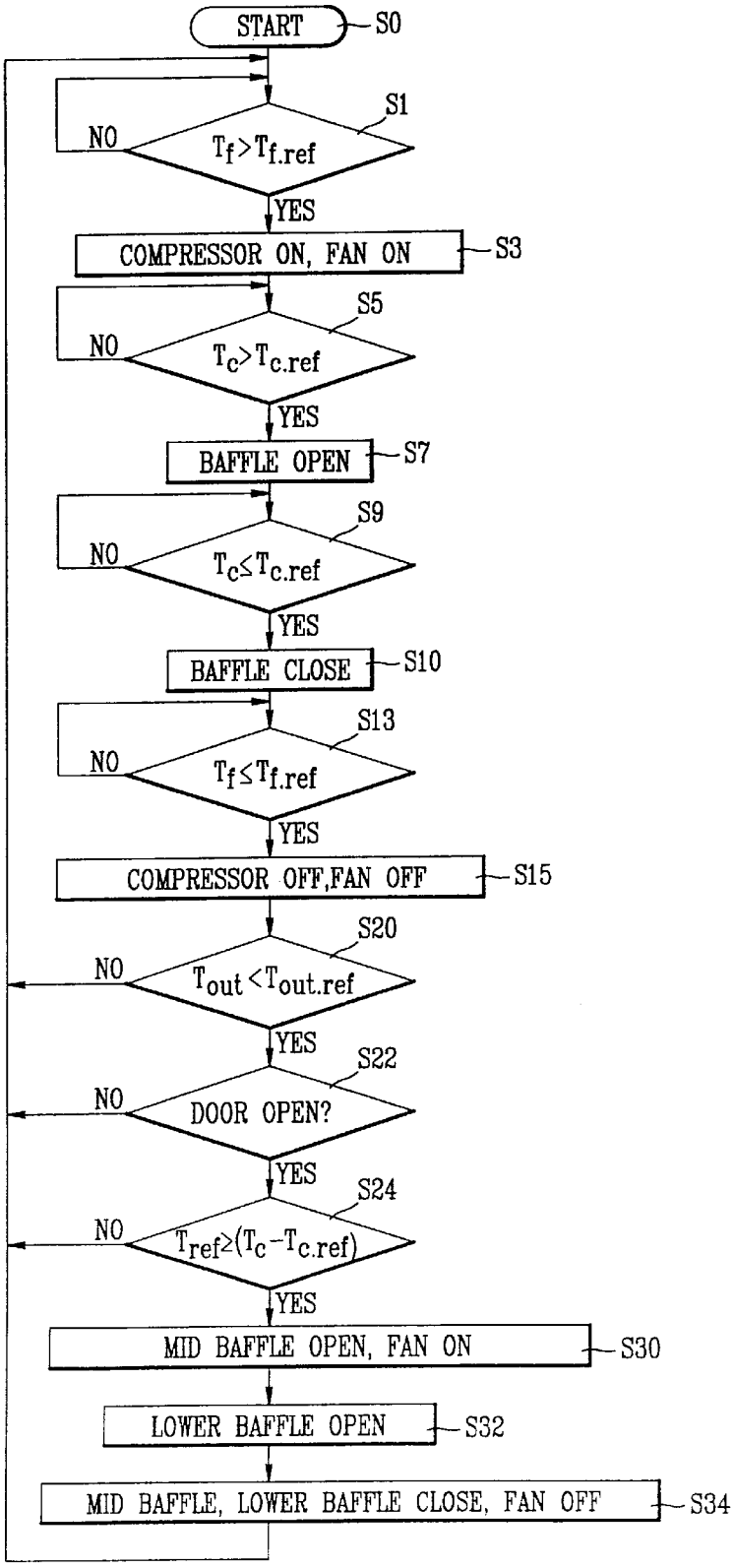

A method for solving the aforementioned problem will be explained with reference to FIGS. 4 and 7. The fitting of the outside temperature sensor 40 for measuring an outside temperature Tout on outside of the refrigerator 1 and the control of the refrigerator operation according to the outside temperature Tout measured by the sensor 40 are identical to the aforementioned embodiment. And, because this method is identical to the aforementioned method up to steps S22 and S24 in which opening of the chilling room door after the compressor and the fan are stopped is detected and temperature differences before and after chilling room door opening and closing are compared, detailed explanations up to the steps will be omitted.

If the temperature difference is greater than a preset reference, a second baffle, i.e., the baffle 22*a* for the low compartment formed nearer to the cooled air flow passage is closed and a first baffle, i.e., a baffle 22 for the middle compartment positioned farther from the cooled air flow passage is opened, for the cooled air to flow toward the baffle 22 for the middle compartment, and the fan is also driven (S30). Therefore, the high temperature and high humidity air in the chilling room 4 rises upward by convection up to the baffle 22 for the middle compartment where flow of the air into the baffle 22 is met by the cooled air coming out of the baffle 22, preventing contact of the high temperature and high humidity air to the baffle 22, and, instead, the air makes heat exchange with the cooled air and flows down, thereby preventing the ice formation on the baffle 22 for the middle compartment. Then, after a while, the air reaches to the baffle 22*a* for the low compartment, from which no cooled air is discharged and at which ice is liable to form because there is no cooled air flow from the baffle 22*a*. Therefore, the baffle 22*a* for the low compartment is opened additionally at a time point ice is about to be formed on the baffle 22*a* for the low compartment(after lapse of a time period since the compressor is stopped), for preventing formation of ice on the baffle 22*a* for the low compartment(S32). In this instance, a time interval between opening of the baffle 22 for the middle compartment and opening of the baffle 22*a* for the low compartment may be determined appropriately according to experiments, taking the freezing room reference temperature Tf.ref, chilling room reference temperature Tc.ref, and an environment in which the refrigerator is in use into consideration. As explained in the aforementioned embodiment, because the possibility of ice formation on the baffles 22 and 22*a* of the damper exists no more when a certain time period lapses, baffles 22 and 22*a* both for the middle compartment and the low compartment are closed, and the fan is stopped (S34).

In order to verify effects of the method of the present invention, experiments of the chilling room door open/closing and the high temperature and high humidity load (food) introduction are conducted according to the related art and the present invention. That is, under a state in which outside temperature Tout is 8.5° C.~12.5° C. and the compressor is stopped, on one side, the baffles 22 and 22*a* both for the middle compartment and the low compartment are opened on the same time according to the related art method, and, one the other side, the baffle 22 for the middle compartment is opened in advance and the baffle 22*a* for the low compartment is opened after 20 min. since the compressor is stopped, and states of ice formation on each of the baffles 22 and 22*a* for the cases are compared. As a result, it is found that there is ice formed on a surface of the baffle 22 for the middle compartment while there is no ice formed on a surface of the baffle 22*a* for the low compartment in the case of the related art method, whereas there are almost no ice formed on the baffles 22 and 22*a* of the middle compartment and the low compartment in the case of the present invention. Moreover, in the present invention, because the baffle 22 for the middle compartment is opened in advance to discharge cooled air, the risen high temperature air is cooled and falls down rapidly. If the baffle 22*a* for the low compartment is opened additionally, to discharge the cooled air, the fallen air cooled further, allowing an effective cooling of an inside of the refrigerator.

It will be apparent to those skilled in the art that various modifications and variations can be made in the method for preventing formation of ice on a damper in a refrigerator of the present invention without departing from the spirit or scope of the invention. Thus, it is intended that the present invention cover the modifications and variations of this invention provided they come within the scope of the appended claims and their equivalents.

What is claimed is:

1. A method for preventing formation of ice on a damper in a refrigerator, comprising the steps of:

(1) driving a compressor and a fan and opening baffles if a freezing room temperature is lower than a freezing room reference temperature and a chilling room temperature is lower than a chilling room reference temperature;

(2) comparing the chilling room temperature to the chilling room reference temperature, to close the baffles if the chilling room temperature is lower than the chilling room reference temperature;

(3) comparing the freezing room temperature to the freezing room reference temperature, to stop the compressor and the fan if the freezing room temperature is lower than the freezing room reference temperature;

(4) comparing an outside temperature of the refrigerator to an outside reference temperature, to return back to the step (1) if the outside temperature of the refrigerator is higher than the outside reference temperature, and determining chilling room door of being opened if the outside temperature of the refrigerator is lower than the outside reference temperature; and, (5) comparing a temperature difference before and after opening/closing of the chilling room door to a given reference temperature, to return back to the step (1) if the temperature difference is lower than the reference temperature, and to open the baffles of the damper and to drive the fan for a given time period if the temperature difference is higher than the reference temperature.

2. A method as claimed in claim 1, wherein, in a case of the damper with two baffles, the two baffles are opened in succession at a fixed time interval in the step (5).

3. A method as claimed in claim 1, wherein the freezing room reference temperature is −18° C., the chilling room reference temperature is 3° C. and the outside reference temperature is 8.5~12.5° C.

4. A method as claimed in claim 1, wherein the time period of the baffle opening and the fan driving in the step (5) is set until a time point at which the chilling room temperature becomes substantially the same with a baffle temperature.

5. A method as claimed in claim 1, wherein the time period of the baffle opening and the fan driving in the step (5) is set until a time point at which a baffle surface temperature becomes 0° C.

* * * * *